US007367376B2

(12) United States Patent
Llagostera Forns

(10) Patent No.: US 7,367,376 B2
(45) Date of Patent: May 6, 2008

(54) ARTICULATED ARM FOR AWNINGS, WITH IMPROVED ELASTIC EFFECT

(75) Inventor: Joan Llagostera Forns, Reus (ES)

(73) Assignee: Llaza, S.A., Reus (Tarragona) (ES)

( * ) Notice: Subject to any disclaimer, the term of this patent is extended or adjusted under 35 U.S.C. 154(b) by 430 days.

(21) Appl. No.: 10/546,663

(22) PCT Filed: Aug. 5, 2003

(86) PCT No.: PCT/ES03/00408

§ 371 (c)(1),
(2), (4) Date: Aug. 23, 2005

(87) PCT Pub. No.: WO2005/017280

PCT Pub. Date: Feb. 24, 2005

(65) Prior Publication Data

US 2006/0151125 A1 Jul. 13, 2006

(51) Int. Cl.
*E04F 10/00* (2006.01)

(52) U.S. Cl. ..... 160/66; 160/70; 160/79; 248/289.11; 248/292.13

(58) Field of Classification Search ..... 160/66, 160/70, 79, 45, 907, 68, 67; 248/289.11, 248/289.31, 292.11, 292.13; 135/88.11
See application file for complete search history.

(56) References Cited

U.S. PATENT DOCUMENTS 2,038,045 A 4/1936 Heiser
2,547,532 A * 4/1951 Mendelsohn ..... 248/292.11
3,354,499 A * 11/1967 Anderson ..... 16/289
4,520,977 A * 6/1985 Holzhauser et al. ..... 248/201
6,070,839 A * 6/2000 Brenner et al. ..... 248/123.11
6,378,829 B1 * 4/2002 Strater et al. ..... 248/276.1
2002/0007922 A1 * 1/2002 Kroener et al. ..... 160/79
2007/0051476 A1 * 3/2007 Forns ..... 160/79

FOREIGN PATENT DOCUMENTS

DE 19633249 A 3/1998
ES 2131448 A 7/1999
FR 2421246 AB 10/1979
WO WO 98/01638 1/1998

OTHER PUBLICATIONS

International Search Report for PCT International Application No. PCT/ES03/00408 mailed Oct. 23, 2003.

* cited by examiner

*Primary Examiner*—Blair M. Johnson
(74) *Attorney, Agent, or Firm*—RatnerPrestia

(57) ABSTRACT

An articulated arm for awnings is disclosed. The articulated arm comprises an arm and a forearm, joined together by respective articulation configurations located at adjacent ends of the same, which enables them to move between open and closed positions. There is a flexible tie bar inside the arm, with a second end anchored to the articulation configuration of end of the forearm and linked by a first end to an elastic traction element anchored to a fixed point on the arm and an elastic compression element located between a stop on the flexible tie bar and a support of the end of the arm in order to produce tension in the tie bar on moving from the open position to closed, generating torque tending towards the open position.

11 Claims, 1 Drawing Sheet

ARTICULATED ARM FOR AWNINGS, WITH IMPROVED ELASTIC EFFECT

This application is a U.S. National Phase Application of PCT International Application No. PCT/ES2003/1000408, filed Aug. 5, 2003.

FIELD OF THE INVENTION

This invention concerns an articulated arm for an awning with improved elastic effect, equipped with an arm and a forearm that articulate with each other and a flexible tie bar associated with an elastic traction element and an elastic compression element in order to push the arm and forearm into an open position.

TECHNICAL BACKGROUND

The articulated arm configuration for an awning that consists of an arm and forearm comprising respective tubular arms with ends terminating in plug-in parts that define articulation configurations is a classic design. The arm and forearm are joined together by means of an articulation formed by two of the said adjacent articulation configurations. Within the profile that makes up the body of the arm is the spring under traction that is joined at one end to a fixed point on the tubular profile and by the other end to a flexible tie bar, which is fixed at the other end to a core of the forearm articulation configuration. A portion of the mentioned flexible tie bar is supported on a surface of the said core relatively removed from the rotation axis of the articulation in order to create, in virtue of the tension produced by the spring under traction, a rotational torque that tends to maintain the arm and forearm in a open position.

International patent application WO 98/01638 of the actual applicant describes an articulation for supporting awnings of the type described above, which contributes a series of improvements for the articulation, and in which the mentioned flexible tie bar comprises a flat belt interiorly fitted with metal reinforcement filaments. This belt includes terminals at its two ends for joining the belt to the traction spring and the core respectively. The two ends of the belt include cast terminals for joining the belt to the elastic traction element and to the core. The said terminals are connected to the ends of the cited metal reinforcement filaments at the ends of the belts.

One inconvenience of this type of awning arm is that the increase in rotational torque provided by the lengthening of the elastic traction element as the arm and forearm move from an open position to a closed one turns out to be insufficient with respect to the increase in resisting torque generated by the tension in the awning at the end of the forearm, taking into account that the arm and forearm adopt ever-increasingly inclined positions with respect to the line of application of the tension in the awning as they close. When the awning canvas is completely wound onto the roll-up bar and the arm is fully folded, the elastic energy accumulated in the elastic traction element may be insufficient to push the loading bar towards an open position as the canvas is unwound.

There is, therefore, a need for an articulated awning arm with an improved elastic effect that provides an initial tension when the arm is sufficiently open to maintain the awning canvas with an adequate level of tension and that possesses sufficient accumulated elastic energy when the arm is closed to push the awning canvas to an open position as the canvas is unwound.

A BRIEF DESCRIPTION OF THE INVENTION

This invention contributes to resolving the previous need by providing an articulated awning arm, with improved elastic effect, which as usual, consists of an arm and a forearm that are joined together by respective articulation configurations located at adjacent ends of the same, which enables them to be changed between the open and closed positions. Inside the said arm is a flexible tie bar with a first end linked to at least one elastic traction element secured to a fixed point on the arm and a second end fixed to the cited articulation configuration at the said end of the forearm. The anchor point for the flexible tie bar and the elastic traction element is such that, in consequence of a relative movement between the arm and forearm on moving from the said open position to the said closed position, a lengthening of the said elastic elements under traction is produced, together with the resulting tension in the said flexible tie bar which generates a torque that tends to push the arm towards the open position. One characteristic of the awning arm of this invention is that it includes at least one elastic compression element located between a stop on the flexible tie bar and a support joined to the said end of the arm in order to produce as a consequence of the said relative movement between the arm and forearm on moving from the said open position to the said closed position, a shortening of the said elastic elements under compression is produced which is added to the cited flexible tie bar tension and contributes to increase the said torque that tends towards the open position.

Preferably, when the arm and forearm are in the open position, the elastic traction element exerts an initial traction tension having a predetermined value, while the elastic compression element exerts an initial zero or negligible value of compression tension. Because the arm and forearm are open they are in minimum positions of inclination with respect to the line of application of canvas tension, the initial traction tension of the elastic traction element is sufficient to maintain the canvas tense, and when the arm and forearm commence to move from the open position to closed, the elastic compression element comes into operation and increases its tension, which is added to that of the elastic traction element, and when the arm and forearm are completely closed, the elastic energy accumulated in both elastic elements is sufficient to push the canvas to an open position when the same is unwound. This arrangement allows the selection of the elastic elements under traction and compression so that they provide an increase in tension in the flexible tie bar in accordance with a predetermined progression as the arm and forearm move from the open position to the closed.

With the awning arm of this invention, it would be advantageous to employ the flexible tie bar described in the cited international patent application WO 98/01638, since this permits a more compact and aesthetic design of the articulation. The elastic traction element may be a helicoidal spring under traction and the elastic compression element may be a helicoidal spring under compression through which the flexible tie bar passes, with the said helicoidal spring under compression being compressed between a stop incorporated into a gripping configuration of the first end of the flexible tie bar and a support located at the entrance to a passage in the articulation configuration at the end of the arm, with the said passage communicating the hollow interior of the arm with the articulation configuration in the end of the forearm where the end of the flexible tie bar is secured.

A BRIEF DESCRIPTION OF THE DRAWINGS

The previous and other characteristics and advantages will be more fully understood by using the following detailed description of a production example in conjunction with the attached drawings, in which.

DETAILED DESCRIPTION OF A PRODUCTION EXAMPLE

Figure 1:
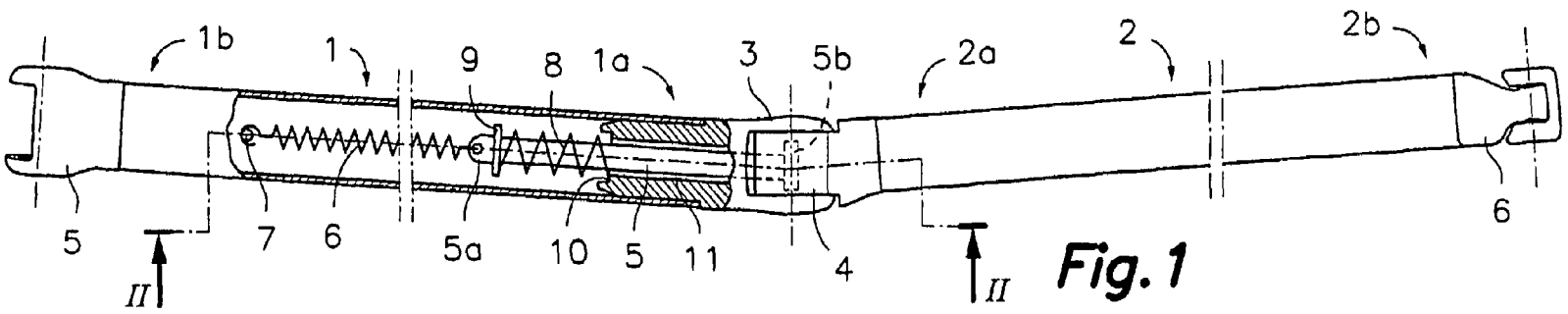
FIG. 1 is a partially sectioned lateral view of the articulated awning arm with improved elastic effect in accordance with this invention in an open position.

Referring, in first place, to FIG. 1, the articulated awning arm, with improved elastic effect, in accordance with this invention, comprises an arm 1 and a forearm 2, joined together by means of respective articulation configurations 3, 4 located at adjacent ends 1*a*, 2*a* of the same. This articulation forms an elbow that permits the arm and forearm 1, 2 assembly to move between open (shown in FIG. 1) and closed positions. In a typical application, arm 1 has, at its other end 1*b*, an articulated anchoring configuration 15 for the articulated joint of the arm and forearm assembly 1, 2 to a fixed support, and the forearm 2 terminates at its other end 2*b* in an articulated support 6 for the articulated connection to an awning loading bar (not shown). The arm and forearm assembly 1,2 moves from the open to the closed positions due to the traction effect of the awning canvas when the same is wound onto a roll-up bar driven either mechanically or manually.

During the closing movement, the articulated support configuration 6 of end 2*a* of the forearm follows a substantially rectilinear path in direction of the articulated anchor 15 of end 1*b* of the arm 1, while the articulation formed by articulation configurations 3, 4 of the adjacent ends 1*a*, 2*a* of the arm 1 and forearm 2 gradually separate from the said path. The path coincides with the line of application of the awning tension, and the increasing distance of the elbow articulation to the said line of application of tension produces an increasing rotational torque at the elbow articulation. In order to counteract the said rotational torque, there is a flexible tie bar 5 inside arm 1 with a first end 5*a* linked to at least one elastic traction element 6 secured to a fixed point 7 on arm 1 and a second end 5*b* anchored to the cited articulation configuration 4 at the said end 2*a* of forearm 2. Between a stop 9 of flexible tie bar 5 and a support 10 joined the said end 1*a* of arm 1 is located an elastic compression element 8. In consequence of a relative movement between the arm 1 and forearm 2 on moving from the said open position to the said closed position, and because of the positioning of the said flexible tie bar 5 described below, a lengthening of the said elastic traction bar 6 is produced, and at the same time, a shortening of the said elastic compression element 8, which, when combined, produces a consequent tension in the flexible tie bar 5 which generates a level of torque that pushes the arm and forearm assembly towards the open position.

Figure 2:
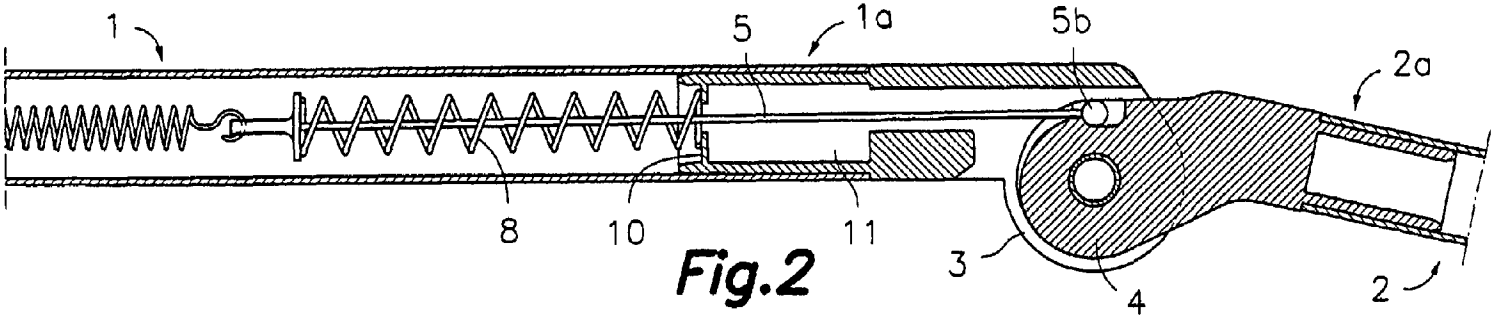
FIG. 2 is a partial transverse section view taken along line II-II in the direction of the arrows.

FIG. 2 shows the arm 1 and forearm 2 in the open position. Arm 1 and forearm 2 consist of tubular profiles in which pieces are plugged into the adjacent ends, which define the respective articulation configurations 3, 4. In the illustrated example, the flexible tie bar 5 is located inside the hollow interior of arm 1 and passes towards articulation configuration 4 and end 2*a* of forearm 2 through passage 11 in articulation configuration 3 of end 1*a* of arm 1. A portion of flexible tie bar 5 is supported on a surface of articulation configuration 4 at some distance from a rotational axis of the articulation. The effect of the tension of flexible tie bar 5 on a support point distant from the articulation axis generates a rotational torque that pushes the arm and forearm towards the open position. In the illustrated production example, the flexible tie bar 5 has the form of a flat belt terminated at the said first and second ends 5*a*, 5*b* by respective gripping configurations, which are connected to internal metal reinforcement cores inside the flat belt. The elastic traction element 6 is a helicoidal spring under traction and the elastic compression element 8 is a helicoidal spring under compression, through which the flexible tie bar 5 passes. The mentioned stop 9 is incorporated into the gripping configuration of the first end 5*a* of the flexible tie bar 5 and the said support 10 is located next to the entrance to the said passage 11 of the end 1*a* of arm 1. The elastic compression element 8 is compressed between stop 9 and support 10 and at the same time the elastic traction element 6 is under traction between the fixed securing point 7 on arm 1 and the gripping configuration on the first end 5*a* of the flexible tie bar 5.

Figure 3:
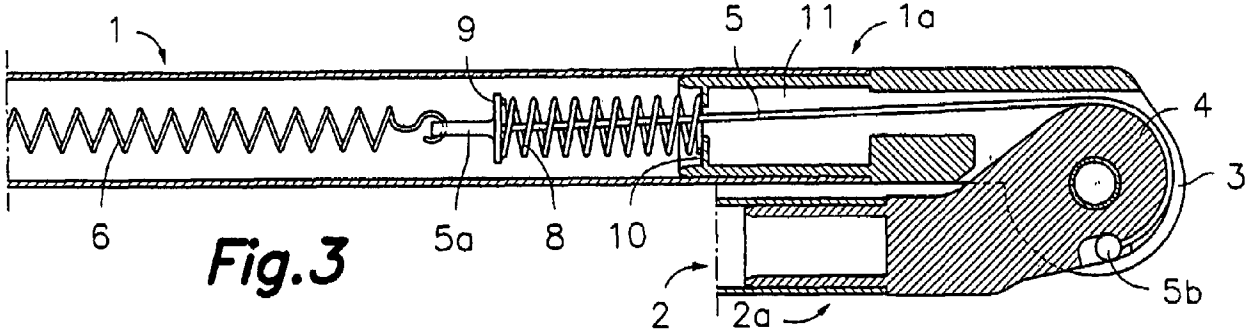
FIG. 3 is a partial transverse section view similar to that of FIG. 2, but with the arm in a closed position.

In the open position shown in FIG. 2, the elastic traction element 6 exerts an initial traction tension of a predetermined value that is sufficient to maintain the awning canvas extended in the open position, while the elastic compression element 8 exerts an initial zero or negligible compression value. As the arm and forearm assembly 1, 2 closes, the tension generated by the elastic traction element 6 increases, which is gradually added to the tension produced by the elastic compression element 8, which contributes to increase the said torque that tends towards the open position. When the arm and forearm assembly 1, 2 reaches the closed position shown in FIG. 3, the elastic traction element 6 is lengthened to the maximum and the elastic compression element 8 is compressed to the maximum, so that the tension in the flexible tie bar 5 is at a maximum and, consequently, the generated torque is also maximum and sufficient to push the loading bar and the canvas awning that is fixed to it, towards the open position when canvas unwinding commences.

Preferably, the elastic traction element 6 and the elastic compression element 8 are selected so that they provides an increase of tension in the flexible tie bar 5 in accordance with a predetermined progression as arm 1 and forearm 2 move from the open position to the closed, in order to counteract the increasing rotational torque produced by the tension in the awning canvas.

The described and illustrated production example has a merely guideline and non-limiting character with respect to the scope of this invention, which is defined by the attached claims.

The invention claimed is:

1. An articulated arm for an awning with improved elastic effect, comprising:

an arm and a forearm, joined together by respective articulation configurations, located at adjacent ends of the same, which permits them to change between open and closed positions, a flexible tie bar located inside said arm, with a first end linked to at least one elastic traction element anchored to a fixed point on the arm and a second end anchored to the articulation configuration at the end of the forearm in order to produce, in consequence of a relative movement between the arm and the forearm on moving from the open position to the closed position, a lengthening of the elastic traction element and a consequent tension in the flexible tie bar, which generates a torque that tends towards the open position, and at least one elastic compression element located between a stop of the flexible tie bar and a support joined to the end of the arm in order to produce, in consequence of the relative movement between the arm and the forearm on moving from the open position to the closed position, a shortening of the elastic compression element and a consequent tension that adds to the tension in the flexible tie bar which contributes to increase the torque that tends towards the open position.

2. The arm in accordance with claim 1, wherein when the arm and the forearm are in the open position, the elastic traction element exerts an initial traction tension having a predetermined value.

3. The arm in accordance with claim 2, when the arm and the forearm are in the open position, the elastic compression element exerts an initial compression tension having a zero or negligible value.

4. The arm in accordance with claim 2, wherein the elastic traction element and the elastic compression element are selected so that they provide an increase of tension in the flexible tie bar in accordance with a predetermined progression as the arm and the forearm move from the open position to the closed position.

5. The arm in accordance with claim 1, wherein the flexible tie bar is located inside a hollow interior zone of the arm and the articulation configuration at the end or the arm includes a passage for the flexible tie bar to the articulation configuration at the end of the forearm, with a portion of the flexible tie bar supported on a surface of the articulation configuration distant from a rotational axis of the articulation.

6. The arm in accordance with claim 5, wherein the flexible tie bar has the form of a flat belt terminated at the first and second ends by respective gripping configurations.

7. The arm in accordance with claim 6, wherein the flat belt includes internal metal reinforcement cores.

8. The arm in accordance with claim 5, wherein the elastic traction element is a helicoidal spring under traction.

9. The arm in accordance with claim 5, wherein the elastic compression element is a helicoidal spring under compression.

10. The arm in accordance with claim 6, wherein the elastic compression element is a helicoidal spring under compression, through which the flexible tie bar passes, where the stop is incorporated into the mentioned gripping configuration of the first end of the flexible tie bar and the support is located next to the entrance to the passage of the end of the arm.

11. The arm in accordance with claim 3, wherein the elastic traction element and the elastic compression element are selected so that they provide an increase of tension in the flexible tie bar in accordance with a predetermined progression as the arm and the forearm move from the open position to the closed position.

* * * * *